US005916070A

United States Patent [19]

Donohue

[11] Patent Number: 5,916,070

[45] Date of Patent: Jun. 29, 1999

[54] EXERCISE DEVICE

[76] Inventor: James P. Donohue, 302 Zimmer Dr., Fairborn, Ohio 45324

[21] Appl. No.: 08/961,909

[22] Filed: Oct. 31, 1997

[51] Int. Cl.[6] ..... A63B 23/12

[52] U.S. Cl. ..... 482/74; 482/114; 482/124

[58] Field of Search ..... 487/74, 127, 124, 487/91, 103, 114–116, 120; D21/191, 195, 198

[56] References Cited

U.S. PATENT DOCUMENTS

| | | | |
|---|---|---|---|
| 1,402,179 | 1/1922 | Piscitelli | 482/124 |
| 4,961,573 | 10/1990 | Wehrell | 482/74 |
| 5,005,832 | 4/1991 | Van Der Hoeven | 482/124 |
| 5,176,377 | 1/1993 | Wilkinson | 482/124 |
| 5,234,395 | 8/1993 | Miller et al. | 482/114 |
| 5,328,437 | 7/1994 | Gvoich | 482/114 |
| 5,399,137 | 3/1995 | Kushner | 482/114 |
| 5,509,873 | 4/1996 | Corn | 482/74 |
| 5,514,059 | 5/1996 | Romney | 482/74 |

*Primary Examiner*—Jerome Donnelly
*Attorney, Agent, or Firm*—Donald P. Gillette

[57] ABSTRACT

An exercise device for exercising a user's upper body including a U-Shaped guard mounted around a user's waist, a non-elastic cord extending around a central portion of the guard, guide means on said guard for positioning the cord to allow free longitudinal sliding movement and a hand hold at each end of the cord to allow the user to grasp one of the hand holds in each hand and force the cord to slide alternately in opposite directions along the guard.

13 Claims, 4 Drawing Sheets

EXERCISE DEVICE

BACKGROUND OF THE INVENTION

1. Field of the Invention

This invention relates to the field of exercise devices and particularly to a device for exercising the arms and torso and directly controlled by the effort put into it by a user.

2. The Prior Art

A number of exercise devices have been suggested for exercising at least the user's torso and arms by having the user apply arm force against an elastic cord or other elastic structure harnessed to the user's body. This has the disadvantage that, if the user desires to change the force that must be supplied by his or her arms, some adjustment must be made in the elastic structure. In addition, the rigid attachment of elastic cords to structures that are attached to the body of a user results in uncomfortable movement of these structures against the body.

Patents based on the use of an elastic structure are:

| Inventor | U.S. Pat. No. | Issued |
|---|---|---|
| Frappier | 5,518,480 | May 21, 1996 |
| Romney | 5,514,059 | May 7, 1996 |
| Davies | 5,433,688 | Jul. 18, 1995 |
| Block | 5,141,223 | Aug. 25, 1992 |
| Wilkinson | 5,137,272 | Aug. 11, 1992 |
| Castellanos | 5,129,647 | Jul. 14, 1992 |
| Wehrell | 5,961,573 | Oct. 9, 1990 |
| Hopkins | 4,540,173 | Sep. 10, 1985 |

In addition to elastic structures, some of the patents have additional structural differences that distinguish them from the present invention, and some place additional constraints on movements by the users.

Other prior exercise devices, while not relying on elastic cords to provide the resistance against which the user's arms have to apply force, also fall short of the present invention.

U.S. Pat. No. 5,462,518 to Hatley et al. does not require that the user's arms work against each other, as in the present invention.

Marshall, in U.S. Pat. No. 5,618,249, issued Apr. 8, 1997, uses recoilers on separate ropes, not one rope that forces the user's arms to exert force against each other by way of an inelastic rope.

In U.S. Pat. No. 1,402,179, Piscitelli shows an exercise device that not only uses a rubber cord but also fails to provide protection for the user's body and thus requires that, instead of moving in a forward direction, the user's arms must move out to each side.

OBJECTS AND SUMMARY OF THE INVENTION

It is an object of this invention is to provide an exercise device that allows a user to determine instantly how much exercising force to use.

Another object is to provide a simple, lightweight exercise device that can be easily carried by a user while it is being used and can provide exercise, particularly for the user's arms and torso, while the user is standing, walking, running, or sitting.

Still another object is to provide an exercise device in which only one component is to be moved during use of the device.

Yet another object is to provide an exercising device that exhibits little or no uncomfortable rotational movement to the body of the user due to the low-friction movement of a non-elastic cord operating against a smooth, rounded guard structure.

Those who are skilled in the technology with which this invention deals will recognize further objects after studying the following description.

In accordance with this invention, a relatively rigid U-shaped guard that fits around the user's back and sides is supported by an adjustable harness, either a belt or straps that hang over the shoulders, to permit the guard to be suspended approximately at level occupied by the user's elbows when the user's upper arms are hanging straight down. This places the guard about at the user's waist. The U-shaped guard protects the user from abrasion by a non-elastic cord loosely carried on the outer surface of the guard with the ends of the cord extending out of the ends of the guard to be grasped by the user's hands and pulled by each hand, alternately, against resistance provided by the other hand. The cord extends though guide means on the guard to keep the cord in contact with the guard, not allowing it to rise above the upper edge of the guard nor to drop below the bottom edge. At each of the forward ends of the guard, the corresponding ends of the cord pass through an aperture shaped to minimize frictional engagement of the cord with any edge of the guard. The ends of the cord are attached to handholds to be grasped by the user's hands, and the only adjustment that need be made in the device is to set the length of the cord to be sufficient to extend from one of the handholds, rearwardly through the aperture in the guard on that side of the user's body, around the user's back, forwardly along the other side of the user's body, through the aperture on the latter side, and out to the other handhold. The total length of the cord in use should be approximately enough so that, when one of the user's arms is extended fully forwardly, the other handhold is pulled back almost to the front end of the guard on that side.

One form of exercise of the user's arms is achieved by applying forward force to both handholds, the forward force applied by one arm being enough greater than the forward force applied by the other arm to move the one handhold forward, forcing the other back. When the one arm is extended as far as the user wishes, the amount of force applied to that handhold is reduced and the force applied to the other handhold is increased to move the latter handhold forward and draw the other one back. Since the only force applied to the cord is that provided by the user's arms, it is under the user's control at every instant. The reversal of forward movement of either arm can be halted at any position, and the rearward movement of that arm can begin at the selected position. The amount of force exerted by the user's arms need not be equal if the user has any impediment in arm strength or movement that would make such unequal force or movement necessary.

Another form of exercise is to use the right hand to hold the handhold attached to the end of the cord extending from the is left side of the guard and the left hand to hold the handhold attached to the other end of the cord. In so doing, it is necessary for each hand to pull the respective handhold forward and somewhat across the user's body against restraining pulling force by the other hand rather than to push it forward against restraining force pushing by the other hand, and different muscles are exercised.

The invention will be described in greater detail in connection with the drawings, in which like serial numbers in different figures indicate the same item.

DETAILED DESCRIPTION OF A PREFERRED EMBODIMENT

Figure 1:
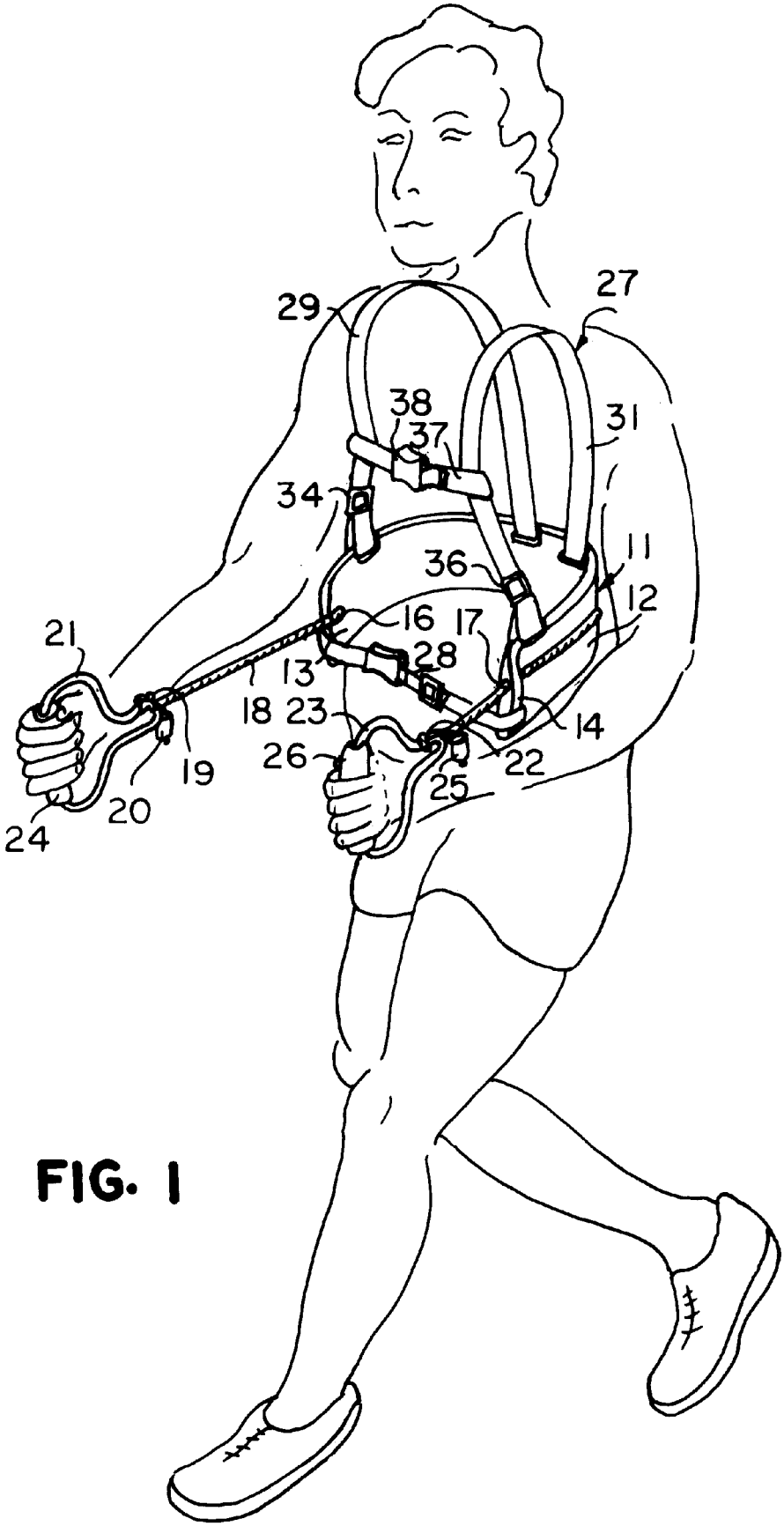
FIG. 1 is a perspective view of one embodiment of the exercise device of this invention.
Figure 2:
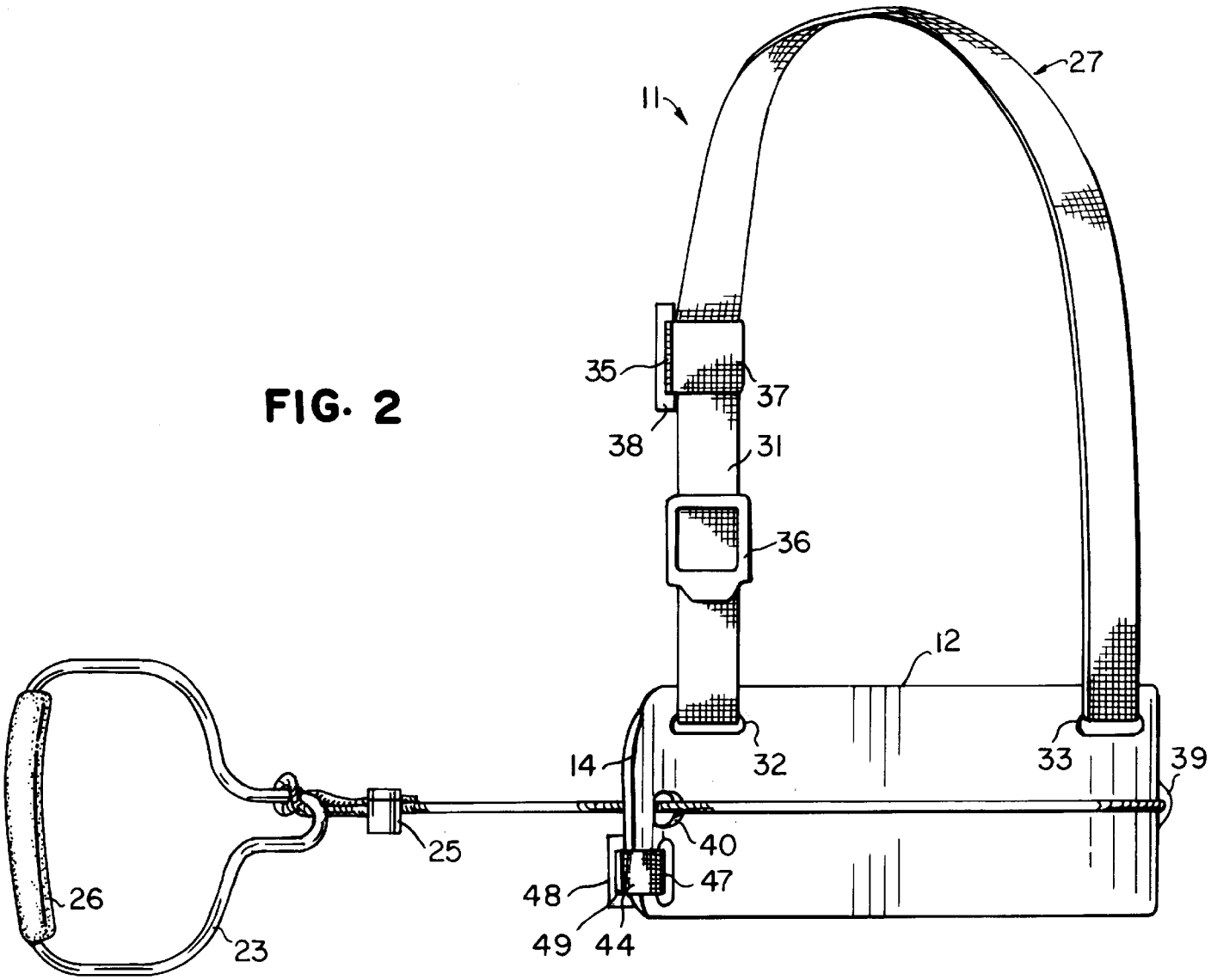
FIG. 2 is a side view of the exercise device shown in FIG. 1.

FIGS. 1 and 2 illustrate an exercise device 11 on a phantom user shown in broken lines so that all parts of the device can be seen. The exercise device 11 includes a generally U-shaped guard 12, which may be a band of sheet metal or other material, such as plastic or leather, that has a relatively low coefficient of friction and enough strength to withstand the wear to which it would be subjected. The guard 12 may be formed originally to have the U-shaped configuration illustrated, or it may be formed as a flat band and then bent into a approximately a semicircle large enough to embrace a person's waist. Bands can then be further adjusted to accommodate different waist sizes, or bands of different sizes may be formed to be used by people having different waist sizes.

The guard needs to be wide enough, as measured in its vertical direction, to be comfortable to the user and not so wide as to be unduly heavy or to have either its upper or lower edge be pressed sharply against the user's body. It is also important that the guard not be restrictive of the user's movements while it is being worn. I have found that a width of about 4" is quite satisfactory. About an inch of the guard 12 at each of its ends 13 and 14 is curved or bent outwardly with respect to the U-shaped curvature of the guard for the safety of a user and to provide guide holes 16 and 17 through which a rope, or cord, 18 extends. As shown, the cord extends around the back part of the guard and is vertically located approximately in the center of the guard. The end 19 of the cord extending from the right side of the guard 12 is looped around a stirrup-like handhold 21 and secured by a barrel lock 20. The end 22 of the cord 18 extending from the left side is tied to a similar stirrup-like handhold 23 and secured by another barrel lock 25. The handholds are provided with grips 24 and 26 that can be grasped more comfortably by the user than can the stirrup-like handholds. Also for the safety of a user, all edges of the guard are smooth and rounded.

The device 11 in this embodiment has a shoulder harness 27 that allows the guard 12 to be comfortably suspended from the user's shoulders. In addition, this embodiment also includes a partial belt 28 that can also be adjusted to cinch the ends of the guard close enough together to support the device 11 comfortably by means of the belt, alone.

In one form of exercise, which is illustrated in FIG. 1, the user of the exercise device 11 extends his or her left and right arms alternately, pivoting them from the shoulders and keeping the forearms pointed more or less straight ahead, about in the plane of the cord 18. The length of the cord is adjusted to be short enough so that both hands cannot be extended forward at the same time. As the heel of the right hand pushes the handhold 21 forward, the handhold 23 applies a pushing force to the heel of the left hand forcing that hand back toward the guard 12. At any point, the user can reverse the amount of forward pressure on the hands and push the left handhold 23 forward with a force great enough to push the right handhold 21 back toward the guard 12.

The amount of force required to extend either hand forward is directly proportional to, and instantaneously controlled by, the forwardly directed force of the other hand. This causes the cord to slide back and forth along the central plane of the guard 12. If the user allows one hand to be freely moved back by forward motion of the other hand, minimum exercise is obtained, but that may be perfectly all right if the user's intent is simply to improve the freedom of movement of the arms or shoulder joints. As the user increases the resistance of each hand to be pushed back by forward movement of the other one, the muscles, particularly in the upper arms and shoulder and upper back areas, are more vigorously exercised. Since the only thing that changes the resistance of the user's hands to being pushed back is the user's own determination that that be so, the intensity of the exercise is entirely and immediately under the user's control.

An alternative form of exercise is for the right hand of the user to grasp the handhold 23 and the left hand to cross over and grasp the handhold 21. Then, by pulling one handhold forward by means of force exerted through the fingers of the respective hand, the other handhold will be pulled back toward its end of the guard 12. This pulling force exercises different muscles than were exercised by the pushing force applied au previously described.

No part of the device 11 in FIG. 1 is connected to the user's legs or to any part of the user's body below about waist level, and, thus, the device can be operated when the user is moving in any direction at any speed or is sitting or even lying down, provided there is no undue drag on movement of the cord 18. This allows the arm and torso exercise using the device 11 to be combined with a variety of other exercises of other parts of the user's body.

The harness 27 in this embodiment comprises flexible shoulder straps 29 and 31 of material that will not abrade the user's body and yet will hold the guard 12 safely in place. FIG. 2 illustrates that one of the shoulder straps 29 is attached to the guard by being threaded through slots 32 and 33 near the upper edge of the guard 12. There are similar slots on the other side of the guard directly behind the slots 32 and 33. The lengths of the straps 29 and 31 can be adjusted by and length-adjustment buckles 34 and 36 to position the guard at the most comfortable height along the user's body. To some extent, the preferred height depends on the exercise being performed, but it is usually approximately at the same level as the user's elbows when the user's upper arms are hanging straight down. This level is close to the level of the user's waist. Another strap 37 connects the straps 29 and 31 together at the upper part of the chest of the user. This strap has to be opened to allow the harness 27 to be put on easily, and so it is provided with a snap buckle 38 and length-adjustment means 35 to help fit the shoulder harness to the user's chest.

The cord 18 used in this embodiment is made of nylon, although it may be made of other materials sufficiently flexible and smooth to slide easily on the surface of the guard 12. The type of nylon used in back packs and on jacket hoods is satisfactory, although the invention is by no means limited to that type of cord 18. The cord must also have enough strength to withstand the stress due to forces exerted on it by the user. The cord should be flexible enough to allow easy sliding movement back and forth on the convex outer surface of the belt and to allow the ends 19 and 22 to be attached and secured to the handholds 21 and 23 by means of the barrel locks 20 and 25.

At the rear center of the guard 12, the cord 18 passes through an eye 39 that cooperates with the other guide means 16 and 17 to prevent the cord from sliding off of the guard, either by rising up over the top of the guard or dropping down below the guard 12 and, in either case, being drawn across the user's unprotected back as the cord is pulled back and forth. Any part of the surface of the eye, including any edge portion, that the cord 18 may rub against should be smoothed off to allow easy and friction-free movement of the cord 18. The same is true of the guide holes 16 and 17 at the front ends 13 and 14 of the guard. As shown in FIG. 2, the guide hole 17 is located in the area where the front end 14 of the guard starts to bend outward. To minimize friction of the cord against the edge of the guide hole 17, its rear edge 40 is smoothed off where the cord rubs across it. The guide hole 16 at the other end 13 of the guard 12 is treated similarly.

Figure 3:
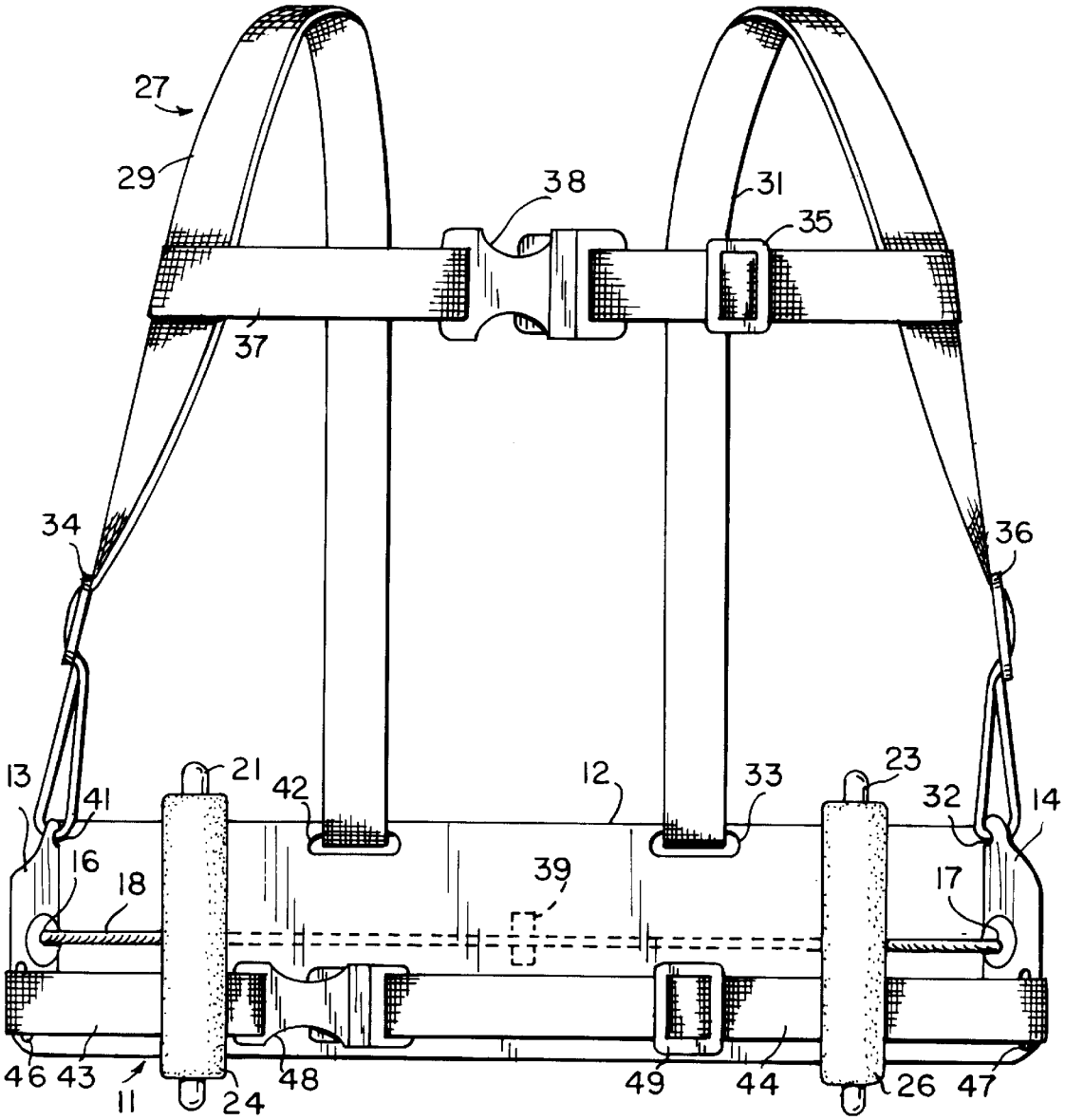
FIG. 3 is a front view of the exercise device shown in the previous figures.

FIG. 3 is a front view of the exercising device 11 and shows slots 41 and 42 that are symmetrically placed with respect to the slots 32 and 33 to receive the ends of the shoulder strap 29.

The belt 28 consists of two parts 43 and 44 attached to slots 46 and 47 at the ends 13 and 14 of the guard 12. When a user dons the device 11, the two parts of the belt are snapped together by a snap buckle 48 and the fit of the guard and belt around the user's waist is adjusted by a length-adjustment buckle 49. The guard can be supported in place by either the shoulder harness or the belt.

Figure 4:
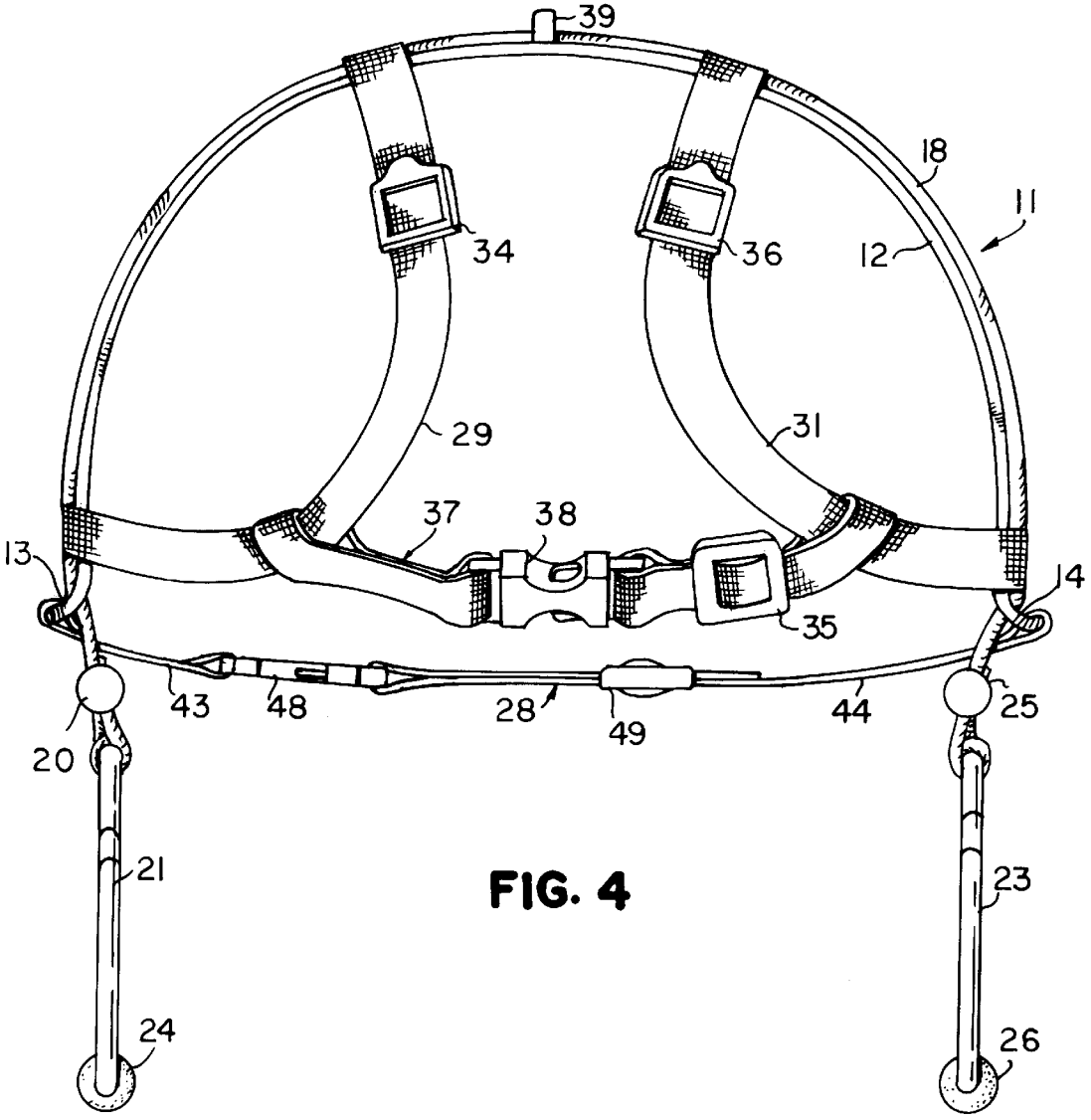
FIG. 4 is a top view of the exercise device shown in the previous figures.

FIG. 4 is a top view of the device 11 showing the way the cord 18 can slide directly backward and forward through the guide holes 16 and 17, which, themselves, can be seen in FIG. 1. It is not necessary that the ends of the cord move exactly parallel with each other; it may be more natural for a given user, based on the user's physical structure, to pull the handholds 21 and 23 somewhat toward or away from each other, but given the smoothing off of the rear edges of the guide holes, as illustrated by the edge 40 in FIG. 2, and given the fact that the dimensions of the guide holes are preferably on the order of twice to four times as great as the diameter of the cord 18, the handholds need not be limited to a straight-ahead movement. As stated above, the handholds can, in fact, be crossed over and held by the opposite hands to allow them to be pulled instead of being pushed.

The invention has been described in terms of a specific embodiment, but it will be apparent to those skilled in the technology with which this invention deals that the concept may be embodied in other forms without departing from the true scope of the invention.

What is claimed is:

1. An exercise device comprising:

(a) a substantially rigid U-shaped guard that comprises:

(i) a central portion with two ends, said central portion having a concave surface and a smooth convex surface, (ii) end portions, each forming an intersection with a respective one of the ends of the central portion and being bent outwardly from the respective end, and (iii) apertures at said intersections;

(b) harness means for supporting the guard on a user with the concave surface of the central portion facing the user and the end portions of the guard facing forward;

(c) a non-elastic cord extending around the central portion on the smooth convex surface and having ends extending through the apertures and beyond the ends of the central portion;

(d) guide means on said U-shaped guard for positioning the cord to allow free longitudinal, sliding movement on the convex surface of the central portion, said guide means comprising the apertures; and (e) a handhold at each end of the cord to allow the user to grasp one of the handholds in each hand and force the cord to slide alternately in opposite directions along the guard by greater force of one hand against lesser force of the other hand.

2. The exercise device of claim 1 in which the guard is a metal band.

3. The exercise device of claim 1 in which the guard is a plastic band.

4. The exercise device of claim 1 in which the guard is approximately 4" high from its bottom edge to its top edge.

5. The exercise device of claim 1 in which the harness means comprises shoulder straps connected to the guard to support the guard from the user's shoulders.

6. The exercise device of claim 5 in which the shoulder straps comprise length-adjustment means to adjust the level of the guard to approximately the level of the user's elbows.

7. The exercise device of claim 1 in which the harness comprises belt means connected to the ends of the guard to cinch the guard sufficiently tightly around the user's waist to support the exercise device.

8. The exercise device of claim 1 in which each end portion of the central portion immediately adjacent the respective apertures is tapered.

9. The exercise device of claim 1 in which the guide means to position the cord for free longitudinal, sliding movement on the guard comprises an eye at the rear of the guard aligned with the cord.

10. The exercise device of claim 1 in which the handholds comprise rigid loops attached to the ends of the cord.

11. The method of using the device of claim 1, said method comprising:

(a) forcing one hand away from the guard with sufficient force to draw the other hand toward the guard at one time; and (b) subsequently forcing the other hand away from the guard with sufficient force to draw the one hand toward the guard.

12. The method of using an exercise device according to claim 11 in which the force is a pushing force applied by heel portions of each hand.

13. The method of using an exercise device according to claim 11 in which the force is a pulling force applied by the fingers of each hand.

* * * * *